US007322441B2

(12) United States Patent
D'Antonio et al.

(10) Patent No.: US 7,322,441 B2
(45) Date of Patent: Jan. 29, 2008

(54) EXTENDED BANDWIDTH FOLDED WELL DIFFUSOR

(75) Inventors: Peter D'Antonio, Upper Marlboro, MD (US); Trevor J. Cox, Chorlton (GB)

(73) Assignee: RPG Diffusor Systems, Inc.MD (US)

( * ) Notice: Subject to any disclaimer, the term of this patent is extended or adjusted under 35 U.S.C. 154(b) by 219 days.

(21) Appl. No.: 11/105,370

(22) Filed: Apr. 14, 2005

(65) Prior Publication Data

US 2006/0231331 A1 Oct. 19, 2006

(51) Int. Cl.
*E04B 1/82* (2006.01)

(52) U.S. Cl. ..... 181/293; 181/284; 181/288; 181/292

(58) Field of Classification Search ..... 181/284, 181/288, 292, 293
See application file for complete search history.

(56) References Cited

U.S. PATENT DOCUMENTS

| | | | | | |
|---|---|---|---|---|---|
| 1,825,770 | A * | 10/1931 | Barnett | 181/293 |
| 1,875,074 | A * | 8/1932 | Mason | 181/293 |
| 2,335,728 | A * | 11/1943 | Heinrich | 181/285 |
| 2,556,884 | A * | 6/1951 | Muller | 181/290 |
| 3,087,567 | A * | 4/1963 | Kurtze | 181/208 |
| 3,269,484 | A * | 8/1966 | Lighter | 181/290 |
| 4,015,682 | A * | 4/1977 | Keller | 181/210 |
| 4,829,728 | A * | 5/1989 | Castelli | 52/145 |
| 4,964,486 | A * | 10/1990 | D'Antonio et al. | 181/285 |
| 5,027,920 | A * | 7/1991 | D'Antonio et al. | 181/285 |
| 5,226,267 | A * | 7/1993 | D'Antonio et al. | 52/144 |
| 5,551,198 | A * | 9/1996 | Schaaf et al. | 52/604 |
| 5,854,453 | A * | 12/1998 | Fujiwara et al. | 181/293 |
| 6,035,965 | A * | 3/2000 | Fujiwara et al. | 181/293 |
| 6,209,680 | B1 * | 4/2001 | Perdue | 181/295 |
| RE37,985 | E * | 2/2003 | Felsen | 454/303 |
| 6,814,182 | B2 * | 11/2004 | Dausch | 181/224 |
| 2003/0006092 | A1 * | 1/2003 | D'Antonio et al. | 181/293 |
| 2005/0072625 | A1 * | 4/2005 | Christenson | 181/210 |
| 2005/0103568 | A1 * | 5/2005 | Sapoval et al. | 181/293 |
| 2005/0167193 | A1 * | 8/2005 | Van Reeth | 181/293 |
| 2007/0034448 | A1 * | 2/2007 | D'Antonio et al. | 181/293 |

FOREIGN PATENT DOCUMENTS

| | | | |
|---|---|---|---|
| DE | 19823139 | A1 * | 10/1999 |
| JP | 02131296 | A * | 5/1990 |

* cited by examiner

*Primary Examiner*—Lincoln Donovan
*Assistant Examiner*—Jeremy Luks
(74) *Attorney, Agent, or Firm*—H. Jay Spiegel

(57) ABSTRACT

An extended bandwidth folded well diffusor extends the diffusion bandwidth of a shallow, asymmetric diffusor by incorporating maximum-depth, folded L-shaped, half-width wells on both ends (sides) of a diffusor, thus providing increased maximum well depth without increasing the physical depth of the diffusor. When the inventive diffusor is placed in an array, the folded L-shaped, maximum-depth, half-width end wells form a novel T-shape, which offers a favorable impedance lowering the resonant frequency, thus extending the diffusor diffusion bandwidth. T-shaped recesses may also be located within a single diffusor. The front surface of the diffusor may be flat or curved or angled.

20 Claims, 9 Drawing Sheets

EXTENDED BANDWIDTH FOLDED WELL DIFFUSOR

BACKGROUND OF THE INVENTION

The present invention relates to an extended bandwidth folded well diffusor. The acoustic performance of diffusors at low frequencies is limited by the size of the diffusor compared to the wavelength of sound. There are generally two distances of importance, the maximum displacement of the diffusor (the diffusor depth), and, if the diffusor is periodic, meaning there are many identical diffusors side-by-side, then the repeat distance between adjacent identical diffusors can also be significant.

As understood by those of ordinary skill in the art, the term "diffusor" as used throughout this text and the claims has the following meaning: "an acoustical device located in a room or space and that receives sound waves from the room or space and is designed to scatter or diffuse those sound waves back into the room or space in a predetermined way based upon design of the diffusor's wells and recesses."

The limitation imposed by repeat distance can be overcome by having no repetition in the device, or by using a modulation scheme. However, the depth available for treatment is often limited. Ultimately, the designer or architect will typically limit the depth available for acoustic treatment, although sometimes the maximum depth is restricted because of concerns about absorption. In any case, with the wavelength of audible sound extending to 17 m (55.8 feet), it is impossible to construct a practical diffusor that will cover the full audible bandwidth with low absorption, and is also usable in most rooms. Consequently, there is always interest in methods for extending the bandwidth of diffusing devices to a lower frequency without making the device deeper.

Previously, various authors have suggested bending the wells of Schroeder diffusers to extend the frequency range over which the well perturbs the sound wave. Also, the folded wells utilize the wasted space at the rear of the diffusor, and so produce more low frequency dispersion. Results have demonstrated that the diffusor with folded wells enables diffusion to occur at a lower frequency from a given maximum depth. As the frequency increases, however, the apparent depth of the folded well changes as most of the sound wave no longer propagates around the bend.

The problem with the folded well construction is the cost of manufacture. Consequently, it has not been often commercially exploited. In addition, shallow diffusers, with a thickness of 1 or 2", are typically molded from a solid block of hardwood, plastic or solid surface material, which is found visually attractive. In these situations, it is not possible to form folded wells in the interior of the diffusor without a secondary operation forming the L-shaped well. The present invention contemplates a new method and design methodology to achieve an asymmetric, bended-well diffusor, which is easy to make and easy to aperiodically modulate.

SUMMARY OF THE INVENTION

The present invention relates to an extended bandwidth folded well diffusor. The present invention includes the following interrelated objects, aspects and features:

(1) In a first aspect, the present invention teaches a novel design and construction means to extend the diffusion bandwidth of a shallow, asymmetric diffusor, by incorporating maximum-depth, folded L-shaped, half-width wells on both ends (sides) of a diffusor, thus providing increased maximum well depth, without increasing the physical depth of the diffusor.

(2) The invention also teaches that by using such design and construction means, the asymmetric diffusor can be aperiodically modulated according to an optimal binary sequence, wherein the base shape and flipped base shape are assigned a binary zero and one, respectively.

(3) The present invention also teaches that when the diffusor is placed in an array, the folded L-shaped, maximum-depth, half-width end wells form a novel T-shape, which offers a favorable impedance which lowers the resonant frequency, thus extending the diffusor's diffusion bandwidth.

Accordingly, it is a first object of the present invention to provide an extended bandwidth folded well diffusor.

It is a further object of the present invention to provide such a device incorporating maximum depth, folded L-shaped, half-width wells on both ends of a diffusor to provide increased maximum well depth.

It is a yet further object of the present invention to increase maximum well depth without increasing the physical depth of the diffusor.

It is a still further object of the present invention to provide such a device wherein adjacent diffusers create a T-shaped well therebetween.

It is a still further object of the present invention to provide such a device wherein at least one T-shaped well is integrally incorporated within a single diffusor.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
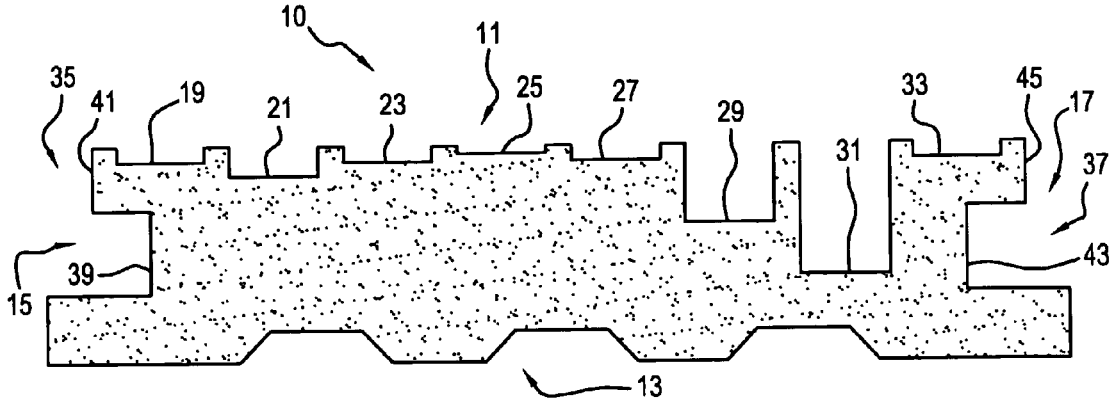
FIG. 1 shows a cross-sectional view of a diffusor in accordance with the teachings of the present invention.

Reference is first made to FIG. 1 which shows a diffusor in accordance with the teachings of the present invention and generally designated by the reference numeral 10. The diffusor 10 has a front face 11, a rear face 13, and side faces 15 and 17. The front face 11 of the diffusor 10 includes a series of wells 19, 21, 23, 25, 27, 29, 31 and 33. The wells 19-33 are similar in configuration to a normal Schroeder diffusor, consisting of a series of wells of the same width and different depths designed to disperse sound waves uniformly. The new feature of the diffusor 10 consists of the laterally open wells 35 and 37. These wells are L-shaped in configuration. The well 35 consists of a deeper portion 39 next to a shallower portion 41 with the portion 41 closer to the front surface 11 of the diffusor 10. Similarly and symmetrically, the well 37 consists of a deeper portion 43 and a shallower portion 45 with the shallower portion 45 being nearer to the front surface 11.

Figure 2:
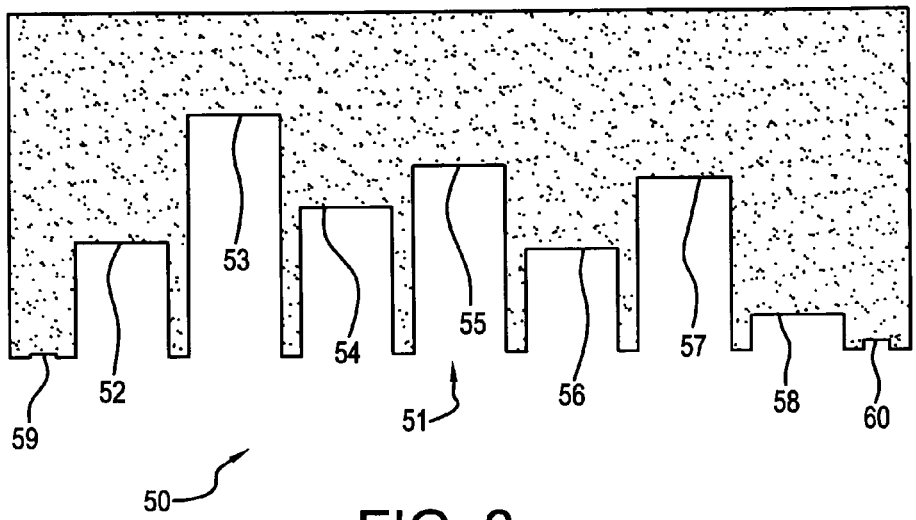
FIG. 2 PRIOR ART
FIG. 2 shows a prior art diffusor with its side extremities defined by zero depth, half-wells.
Figure 10A:
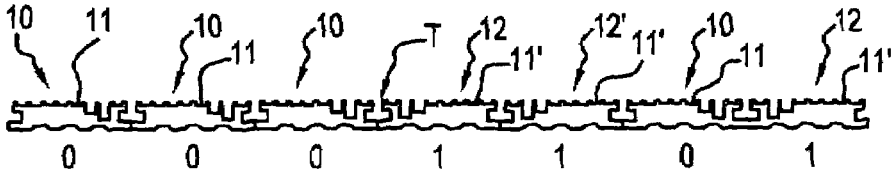
FIGS. 10*a* and *b* show an array of diffusors created by combining a plurality of diffusors in accordance with FIGS. 8 and 9 with a plurality of diffusors assigned a BINARY 1 flipped 180 degrees from the configuration shown in FIGS. 8 and 9.

Thus, the new design incorporates maximum depth, half-width wells on both ends of the diffusor as opposed to the traditional zero depth, half wells known in the prior art. In this regard, reference is made to FIG. 2 that depicts a typical prior art diffusor 50 having a front surface 51 composed of a plurality of full width wells 52, 53, 54, 55, 56, 57 and 58 of varying depths as in a normal Schroeder diffusor and end wells 59 and 60 that are each of half width and zero depth as is traditional in a prior art Schroeder diffusor. As should be understood with reference to FIG. 10*a*, when a plurality of diffusers such as the diffusor 10 or mirror images thereof are placed side-by-side, at the lateral interface between adjacent diffusers, a T-shaped well is formed by one L-shaped well such as the well 35 or 37, and the adjacent L-shaped well in the adjacent diffusor that is a mirror image thereof or in the same orientation. In FIG. 10*a*, a T-shaped well is designated by the reference character "T." A T-shaped well T defined by adjacent mirror image L-shaped wells or two L-shaped wells identically oriented provides the desired extended length folded wells in accordance with the teachings of the present invention.

The present invention teaches a novel approach by placing half of the deepest folded L-shaped well on each side of the diffusor, such that conventional woodworking molders may create the side cut. Wood molders cannot create a folded L-shaped well in the interior of the diffusor, in one operation, because the cutters are perpendicular to the diffusor surface. By placing the maximum depth half wells at the sides of the diffusor, a solid rectangle of wood or plastic can be extruded with conventional tooling.

The impedance of this new well shape can be modeled using a transfer matrix approach. The surface impedance is calculated for the top of the $i^{th}$ layer, this is then used to calculate the impedance at the top of the $(i+1)^{th}$ layer. The process is then repeated until all layers have been evaluated. The relationship that enables this process, relates the surface impedance at $x=x_{i+1}$ to the impedance at $x=x_i$:

$$z_{si+1} = \frac{-jz_{si}\rho c\cot(kd_i) + (\rho c)^2}{z_{si} - j\rho c\cot(kd_i)} \tag{1}$$

Where:

$z_{si}$ is the impedance at $x=x_i$;

$z_{si+1}$ is the impedance at $x=x_{i+1}$;

ρ is the density of air;

c the speed of sound in air k is the wavenumber, and $x_i$ and $x_{i+1}$ are the positions at the top and bottom of the layer.

Figure 3:
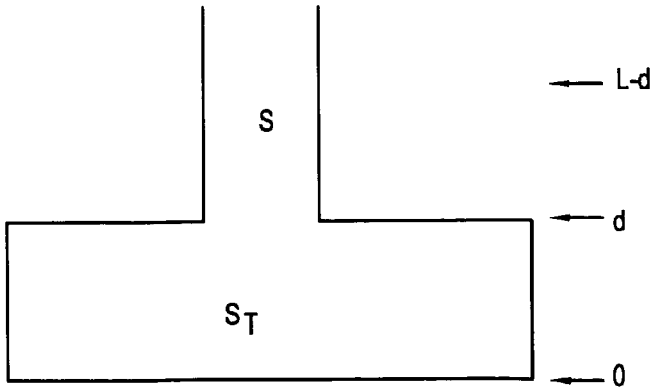
FIG. 3 shows a schematic representation of a T-shaped well.

With reference to FIG. 3, the impedance at point d, is given by:

$$z_d = -j\rho c \cot(kd) \tag{2}$$

and at point L−d $$z_{L-d} = \frac{-j\frac{S}{S_T}z_d\rho c\cot(kL) + (\rho c)^2}{\frac{S}{S_T}z_d - j\rho c\cot(kL)} \tag{3}$$

It is assumed, in the above calculations, that all horizontal dimensions are less than half a wavelength. S is the cross-sectional area of the well mouth, and $S_T$ the cross-sectional area of the bottom of the T.

Figure 4:
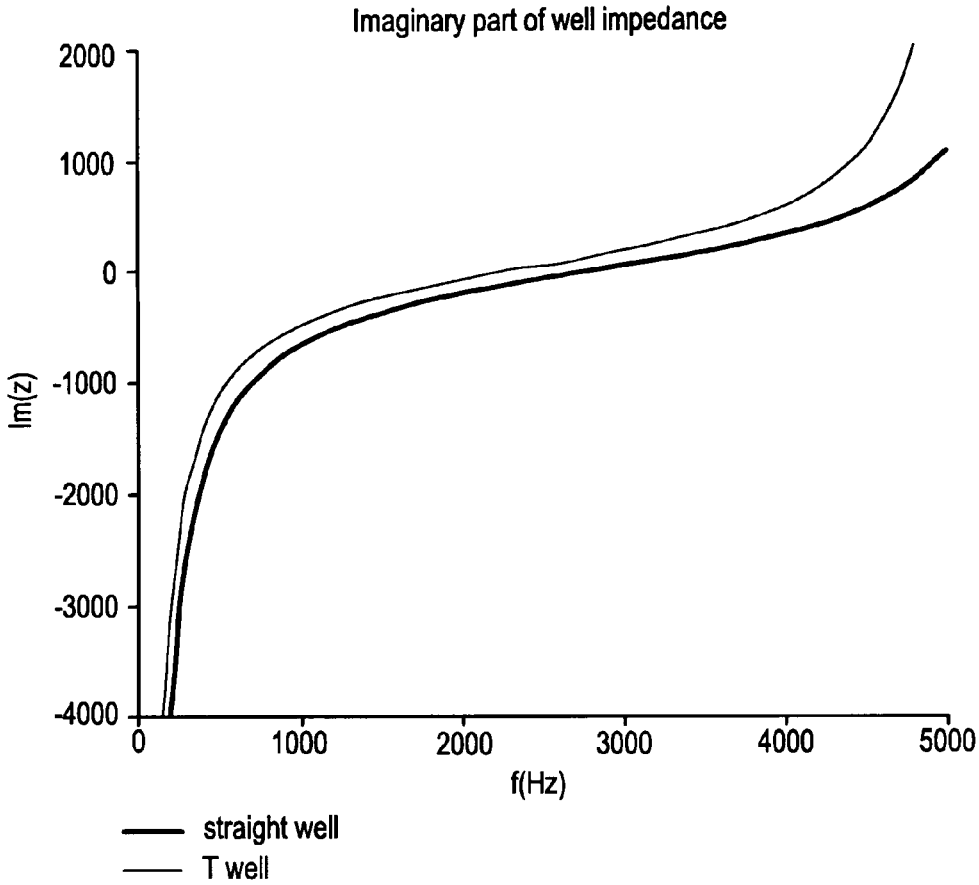
FIG. 4 shows a graph comparing impedance of a straight well with impedance of a T-shaped well as a function of frequency.

FIG. 4 shows the imaginary part of the impedance of a T-shaped well at the well mouth in comparison to that of a straight well, without the side cuts forming the T. Systems resonate when the imaginary part of the impedance is zero. It can be seen in FIG. 4 that the resonance has shifted to a lower frequency for the T-shaped well, indicating the ability of this well to perturb the sound field at a lower frequency and hence cause diffusion at a lower frequency.

The best methodology for designing phase grating diffusers with a small number of wells per period is to use optimization, which is not restricted to a prime number of wells, nor number theoretic quantized well depths. de Jong and van den Berg developed the idea of using an iterative solution method to produce Schroeder style diffusers. It wasn't until co-applicant, Trevor Cox, rediscovered this idea in the early 1990s, however, and co-applicant, Peter D'Antonio, provided experimental evidence for the improved performance over traditional number theoretic Schroeder diffusers, that this concept could be exploited herein.

Figure 5:
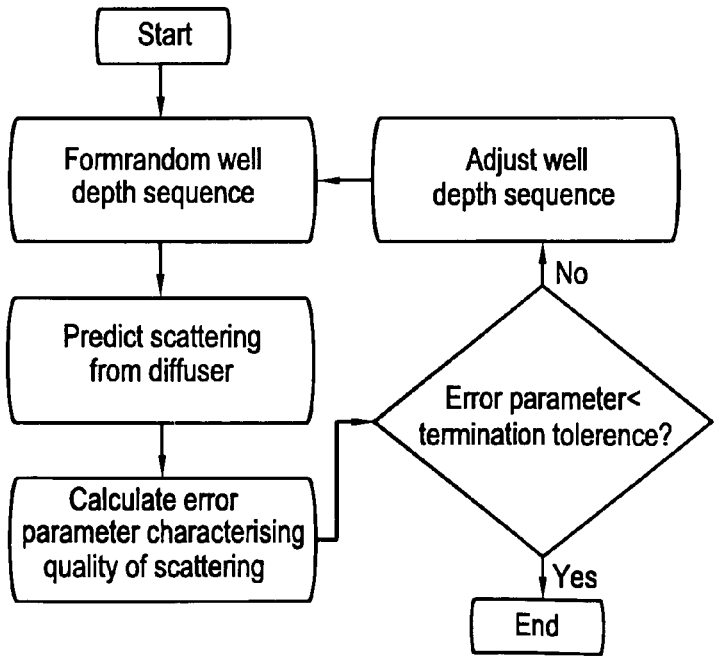
FIG. 5 shows a flowchart explaining a manner of designing a diffusor in accordance with the teachings of the present invention.

The concept of optimization is illustrated in FIG. 5. The idea is to use a computer to execute a trial and error process searching for the best well depth sequence possible. First, a starting well depth sequence is randomly chosen. Then the computer is programmed to predict the scattering from the surface and to evaluate the quality of the scattering in a single figure of merit. The computer then adjusts the well depth sequence in an effort to improve the error parameter. When a minimum in the error parameter is achieved, the iteration process has completed, and an optimum diffusor has been found. This optimization process is a common technique and has been exploited in a wide range of engineering applications. To achieve an optimization of diffusors, several key ingredients need to be in place.

1. A validated prediction model
2. A figure of merit or error parameter;
3. An optimization algorithm to change the well depth sequences.

A validated prediction model is needed, and for this a Boundary Element Model is used. The diffusion coefficient can be used to evaluate the quality of the scattering produced by the surface in a single figure of merit. The diffusion coefficient is evaluated at each frequency band of interest, say each ⅓ octave band. The diffusion coefficients are then averaged across frequency to obtain a single figure of merit. An optimization algorithm is used to adjust the well depth sequence during the search. It is needed so the different well depth sequences can be tried and tested in a logical manner rather than by a completely random trial and error basis. There are a variety of algorithms available for optimization. As is normal practice, the optimizer is run many times from random starting positions, and the best solution chosen. When carrying out the optimization on this diffusor, it is most efficient to use a BEM model where the diffusor is modeled as a box with a variable admittance on the surface.

Figure 6:
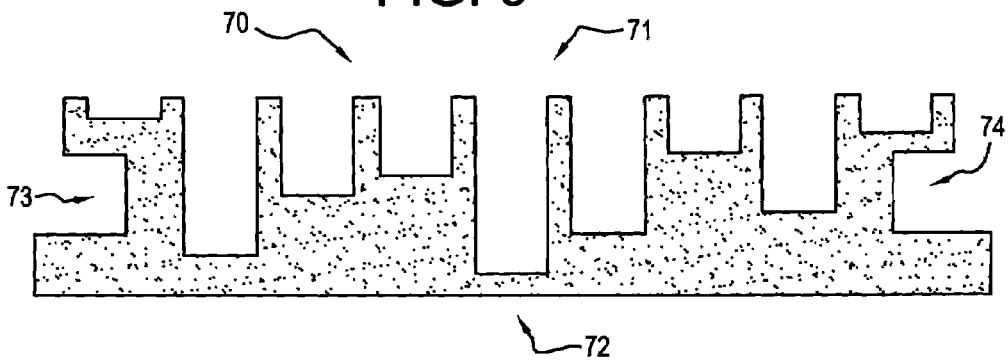
FIG. 6 shows an example of a second embodiment of diffusor in accordance with the teachings of the present invention.

While optimum performance is derived from aperiodically modulating an asymmetric, optimized diffusor, the invention is not restricted to only optimized surfaces. An example is a primitive root, number theoretic surface based on prime number 11, with 10 wells. FIG. 6 illustrates the cross-section design of such a diffusor, designated by the reference numeral 70.

With reference to FIG. 6, the diffusor 70 includes a front surface 71, a rear surface 72, and side surfaces 73 and 74. The front surface 71 is made up of a plurality of full width wells of differing depths in a number theory sequence, and the side surfaces 73 and 74 each consist of L-shaped wells.

Figure 7:
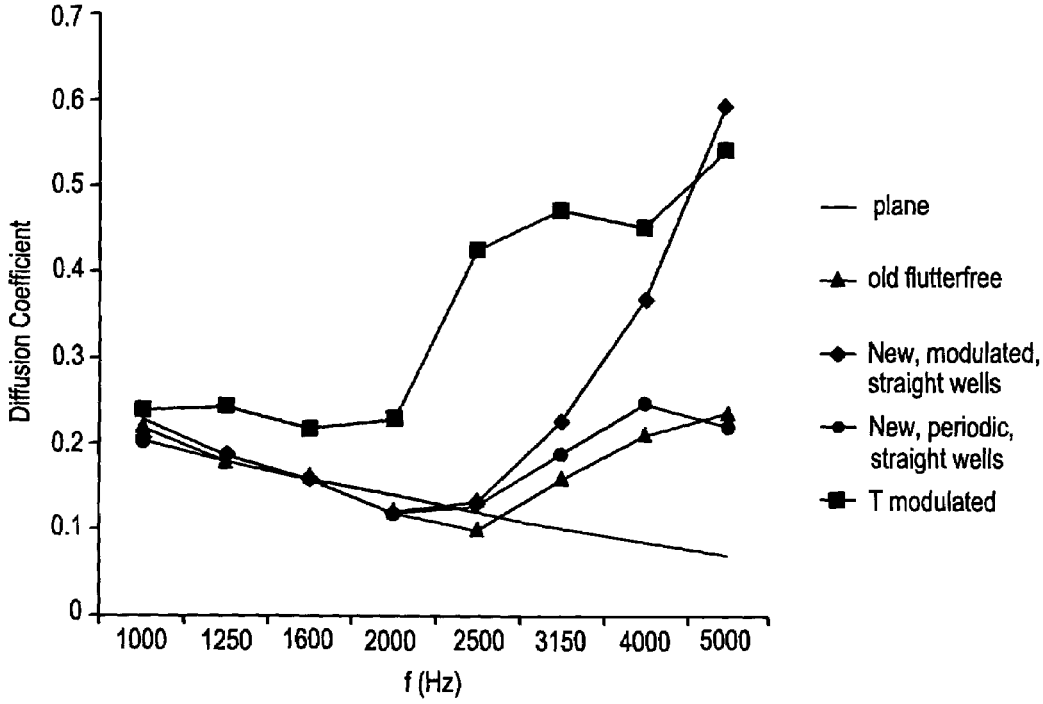
FIG. 7 shows a graph of diffusion coefficient versus frequency for five different acoustic surfaces.
Figure 8A:
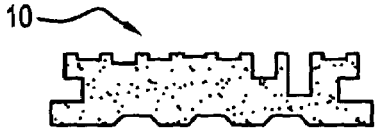
FIGS. 8*a-d* show top, cross-sectional, side and front views, respectively, of a preferred embodiment of diffusor.
Figure 8B:
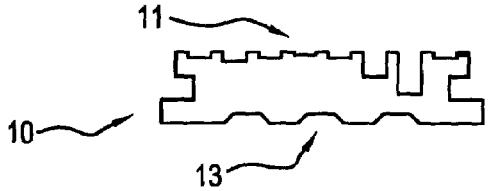
Figure 8C:
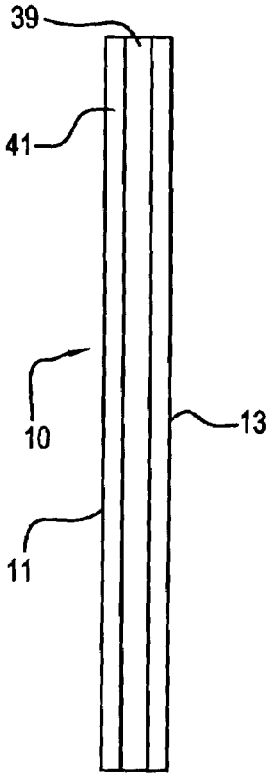
Figure 8D:
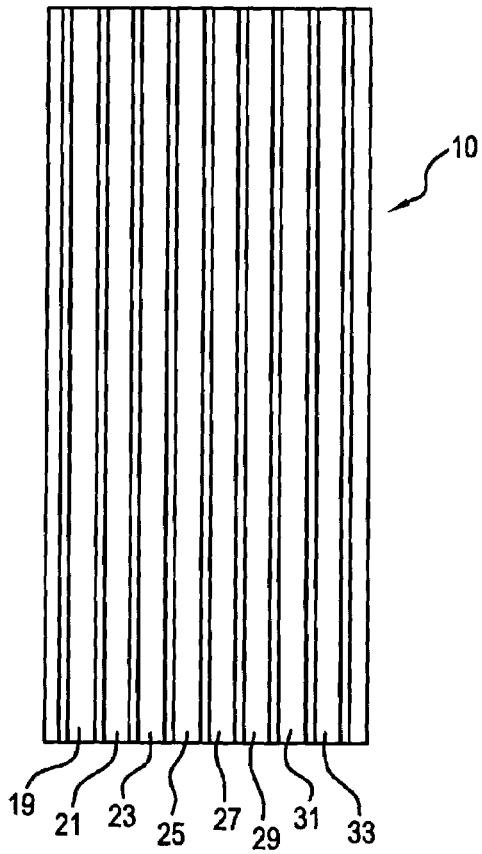

In FIG. 7, we show the dramatic improvement in diffusion coefficient for the invention as compared to a variety of other surfaces. The diffusion coefficient is determined according to AES-4id-2001. All units are 27 mm (1.064") thick. The benchmark is a flat surface indicated by a solid line. The triangle indicates the performance of 9 periods of a traditional QRD diffusor 100 mm wide. The circle indicates the performance of a periodic arrangement of 7,128 mm diffusers with the new optimized well depth sequence. The diamond indicates an aperiodic modulated arrangement of 7,128 mm diffusers, with the new optimized well depth sequence. The square indicates the performance of an aperiodic modulated arrangement of 7, 128 mm diffusers, with the T-shaped wells, as illustrated in FIG. 10. Ideal diffusion is achieved when the diffusion coefficient is unity. It can be seen that the modulated arrangement of T-wells offers a significant improvement in both the low and high frequencies compared to traditional diffusers, while maintaining the same diffusor depth. This represents a dramatic improvement in scattering performance in applications where the surface depth is restricted.

Figure 9A:
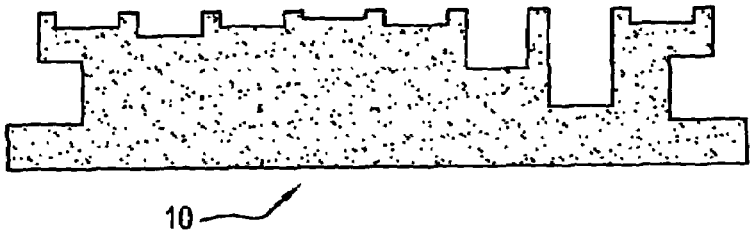
FIGS. 9*a* and *b* show enlarged views corresponding to FIGS. 8*a* and *b*, respectively.
Figure 9B:
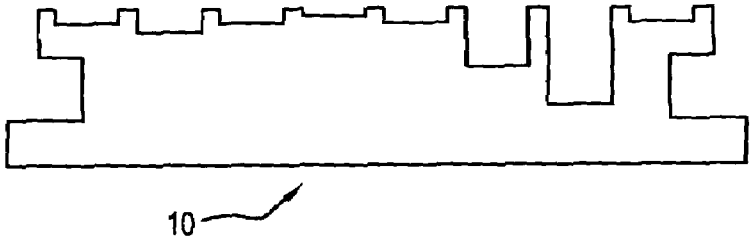

With reference to FIGS. 8*a-d,* different views of the diffusor illustrated in FIG. 1 are shown. FIGS. 9*a* and *b* show the diffusor illustrated in FIGS. 1 and 8*a-d,* but showing detailed design parameters for the diffusor calculated in accordance with the teachings of the present invention.

Figure 10B:
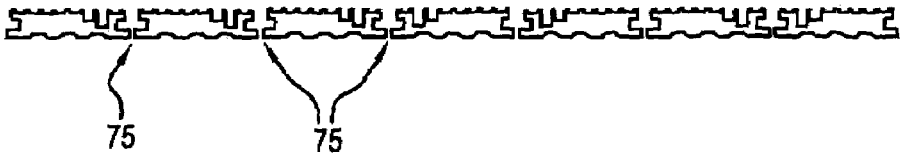
Figure 11A:
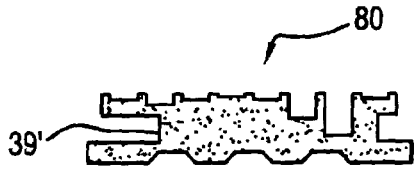
FIGS. 11*a-d* show top, cross-sectional, side and front views, respectively, of a third embodiment of diffusor.
Figure 11B:
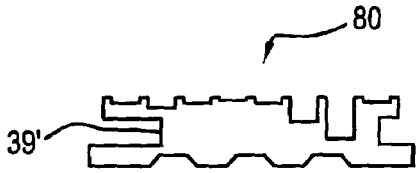
Figure 11C:
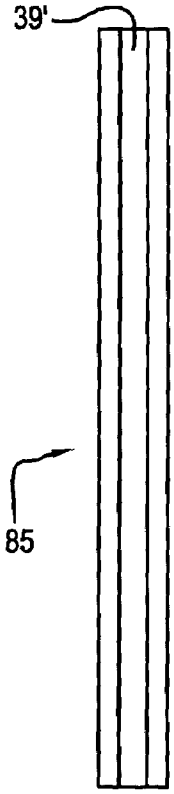
Figure 11D:
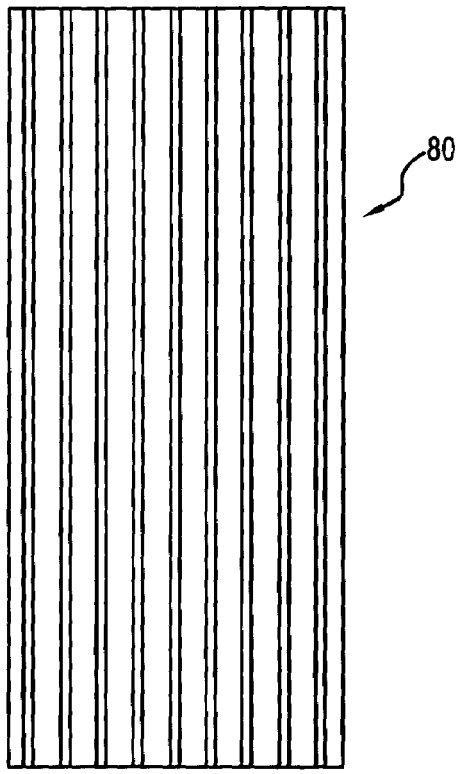
Figure 12A:
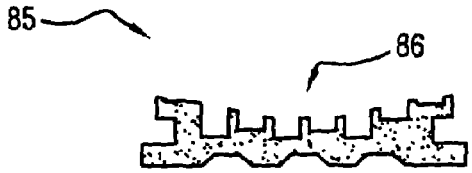
FIGS. 12*a-d* show top, cross-sectional, side and front views, respectively, of a fourth embodiment of diffusor.
Figure 12B:
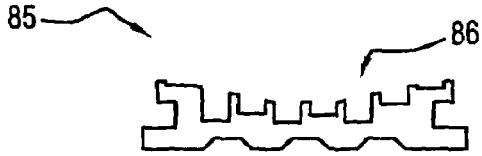
Figure 12C:
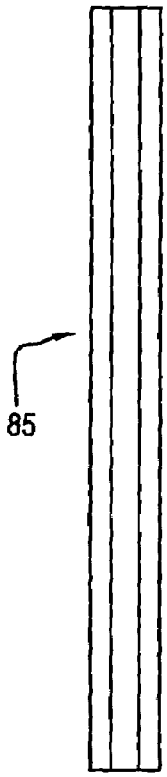
Figure 12D:
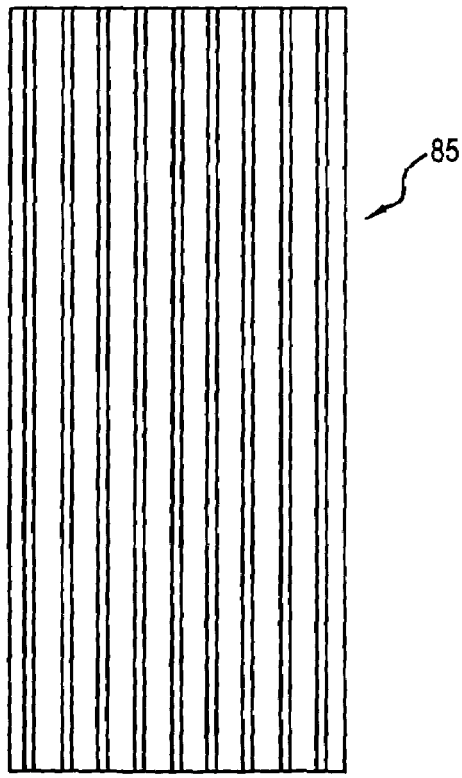

FIGS. 10*a* and *b* show an array of diffusers created with a plurality of diffusers 10 and a plurality of diffusers 12. The diffusers 12 have front surfaces 11' that are mirror images of the front surfaces 11 of the diffusors 10. In other words, the front surfaces 11' are flipped 180 degrees with respect to the front surfaces 11. Modulation in the embodiment of FIGS. 10*a* and *b* is accomplished using optimal binary sequences, in which the preferred embodiment is assigned a binary zero (or one) and the flipped version is assigned a binary one (or zero). This aperiodic modulation of a single asymmetric base shape has been described in D'Antonio U.S. Pat. No. 6,772,859 B2. FIG. 10*b* shows that the diffusers can also be mounted with a small spacing 75 therebetween, which allows sound to enter the cavity behind them. This spacing, rear cavity depth and porous material in the rear cavity can be configured as a Helmholtz absorber to absorb low frequency sound. FIGS. 11*a-d* illustrate a method to further extend the low frequency limit of diffusion, by extending the left hand L-shaped well 39' deeper into the unit. FIGS. 12*a-d* illustrate a diffusor 85 with a concave front surface 86, with embedded optimized well depths defined by front openings located at differing depths, to show that the surface need not be restricted to a flat envelope. FIGS. 13*a-d* illustrate that the optimized wells need not be linear, but can be sinusoidal, assuring that when the surface is flipped 180 degrees it seamlessly joins to an adjacent surface, thus providing the ability to aperiodically modulate a single asymmetric, optimized base shape.

Figure 13A:
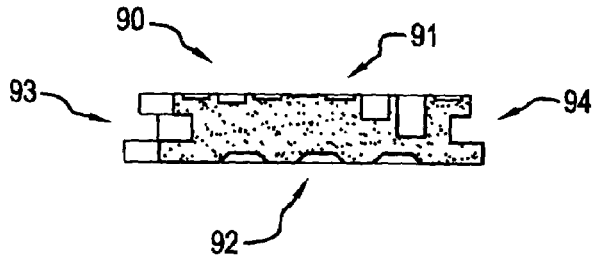
FIGS. 13*a-d* show top, cross-sectional, side and front views, respectively, of a fifth embodiment of diffusor.
Figure 13B:
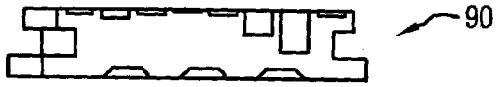
Figure 13C:
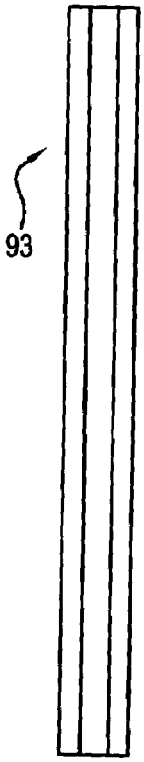
Figure 13D:
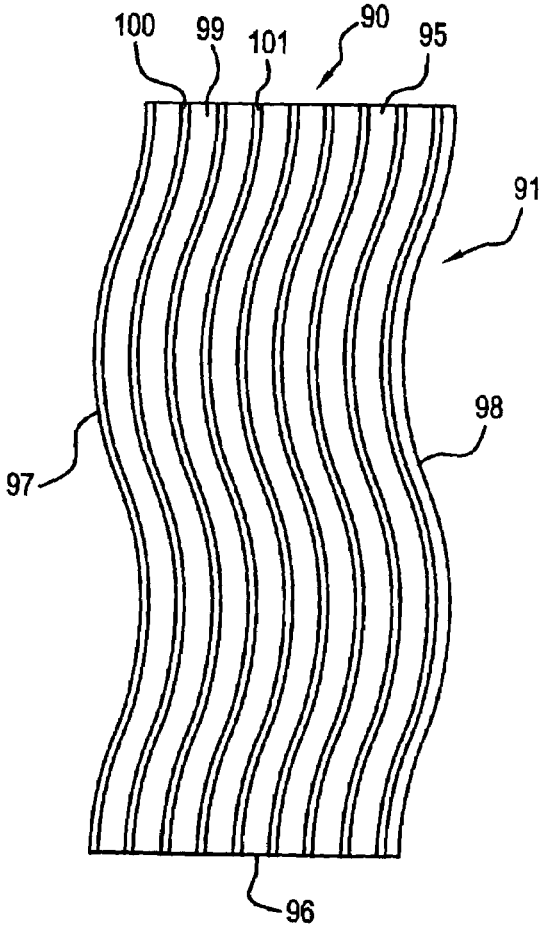

With reference to FIGS. 13*a-d,* a sinusoidal diffusor is generally designated by the reference numeral 90 and includes a front surface 91, a rear surface 92, and side surfaces 93 and 94. As best seen in FIG. 13*d,* the front surface 91 includes flat upper walls 95 and 96 as well as sinusoidal side walls 97 and 98, with the wells, for example, the well 99 defined by sinusoidal side ridges 100 and 101 that are "parallel" with the side walls 97 and 98.

Figure 14:
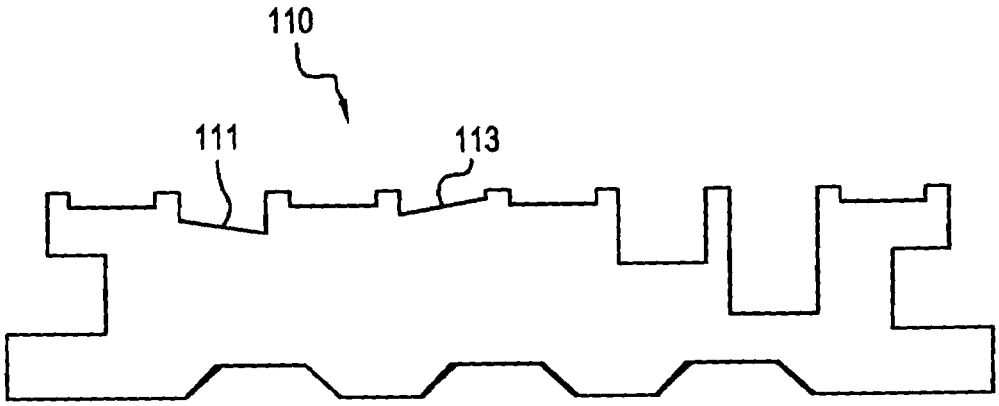
FIG. 14 shows a cross-sectional view of a sixth embodiment of diffusor including slanted wells.

FIG. 14 depicts a diffusor 110 similar to the diffusor 10, but with certain well bottoms 111 and 113 slanted. Applicants have found that the present invention is equally applicable where the wells have bottoms that are slanted, concave, convex, or any desired surface configuration.

Figure 15:
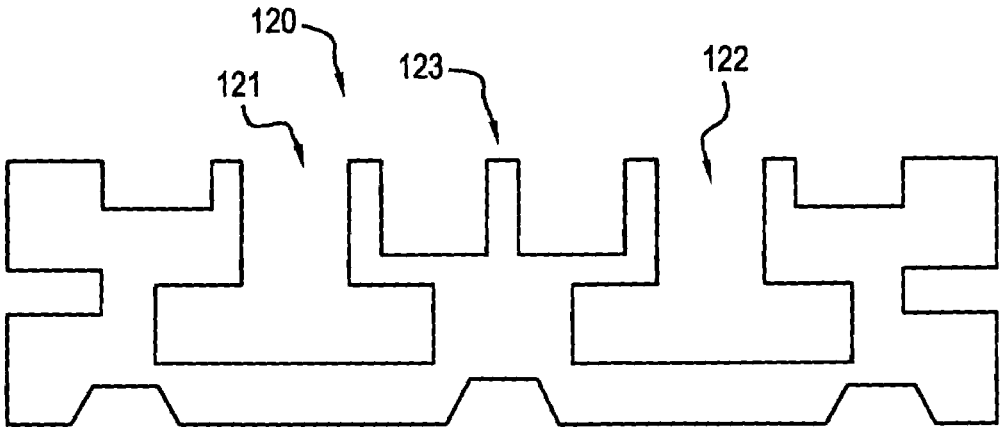
FIG. 15 shows a cross-sectional view of a seventh embodiment of diffusor including a plurality of internal T-shaped wells.

FIG. 15 shows an alternative embodiment designated by the reference numeral 120 in which two wells 121 and 122, that are entered via the front surface 123 of the diffusor 120, have T-shaped cross-sections. Applicants have found that the biggest performance improvements over the prior art are achieved using asymmetric optimized and aperiodically modulated diffusor shapes. However, some improvement can also be obtained by incorporating T-shaped wells into symmetrical number theoretical diffusers, albeit using a secondary fabrication operation. The diffusor 120 consists of a quadratic residue diffusor.

The present invention is not restricted to diffusers made of molded wood, plastic or solid surface materials. The inventive diffusers, in accordance with the teachings of the present invention, may be made equally effectively through the use of extruding technologies involving use of materials such as plastic, metal, wood/plastic composites, and the like. Through use of these extruding technologies, both internal and side folded wells can easily be formed.

As such, an invention has been disclosed in terms of preferred embodiments thereof which fulfill each and every one of the objects of the invention as set forth hereinabove, and provide a new and useful extended bandwidth folded well diffusor of great novelty and utility.

Of course, various changes, modifications and alterations in the teachings of the present invention may be contemplated by those of ordinary skill in the art without departing from the intended spirit and scope thereof.

As such, it is intended that the present invention only be limited by the terms of the appended claims.

The invention claimed is:

1. An acoustical device located in a space, comprising:

a) at least one diffusor having a front face and at least one side face;

b) said front face having a plurality of wells;

c) said at least one diffusor including at least one forward facing T-shaped sound diffusing recess, said recess being defined by a first leg opening at said front face and leading rearward to a second leg defining a chamber, said first leg having opposed sides and a direction of elongation and extending into said at least one diffusor from said front face in said direction of elongation, and said second leg extending laterally of each side of said first leg; and d) said wells and recess receiving sound waves from said space and diffusing said sound waves back into said space exterior of said device.

2. The device of claim 1, wherein said at least one diffusor comprises a single diffusor, said recess first leg having opposed sides defined in said front face.

3. The device of claim 2, wherein said second leg is enclosed within said single diffusor.

4. The device of claim 2, wherein said at least one T-shaped recess comprises a plurality of laterally spaced T-shaped recesses.

5. The device of claim 1, wherein said at least one diffusor comprises a plurality of diffusors.

6. The device of claim 5, wherein said diffusors are located laterally adjacent one another.

7. The device of claim 6, wherein side faces of said adjacent diffusors face one another.

8. The device of claim 7, wherein a side face of a first diffusor has a first L-shaped recess and a side face of a second diffusor has a second L-shaped recess, said first and second recesses together defining a T-shaped recess between said first and second diffusors.

9. The device of claim 7, wherein said first leg of said T-shaped recess between said first and second diffusors opens between front faces of said diffusors and said second leg of said T-shaped recess between said first and second diffusors defines said chamber.

10. The device of claim 8, wherein said diffusors are slightly laterally spaced from one another, whereby said T-shaped recess between said first and second diffusors is rearwardly open.

11. The device of claim 5, wherein said plurality of diffusors comprises first and second diffusors.

12. The device of claim 11, wherein said first diffusor has a first front face with a first plurality of wells configured in a first sequence of respective depths, and said second diffusor has a second front face with a second plurality of wells configured in a second sequence of respective depths.

13. The device of claim 12, wherein said second sequence is a mirror image of said first sequence.

14. The device of claim 1, wherein said front face is concave.

15. The device of claim 1, wherein said front face is laterally defined by sinusoidal side edges.

16. The device of claim 1, wherein a bottom surface of at least one of said wells is angled with respect to said front face.

17. An acoustical device located in a space, comprising:

a) a plurality of diffusors, each having a front face and at least one side face;

b) said front face of each diffusor having a plurality of wells;

c) said diffusors including at least one forward facing T-shaped sound diffusing recess, said recess being defined by a forwardly open first leg leading rearward to a second leg defining a chamber, said first leg having opposed sides and a direction of elongation and extending into said at least one diffusor from said front face in said direction of elongation, and said second leg extending laterally of each side of said first leg; and d) said wells and recess receiving sound waves from said space and diffusing said sound waves back into said space exterior of said device.

18. The device of claim 17, wherein said at least one T-shaped recess comprises a plurality of laterally spaced T-shaped recesses.

19. The device of claim 17, wherein a side face of a first diffusor has a first L-shaped recess and a side face of a second diffusor has a second L-shaped recess, said first and second recesses together defining a T-shaped recess between said first and second diffusors.

20. The device of claim 19, wherein said diffusors are slightly laterally spaced from one another, whereby said T-shaped recess between said first and second diffusors is rearwardly open.

* * * * *